US008149190B2

(12) United States Patent
Mizukoshi et al.

(10) Patent No.: US 8,149,190 B2
(45) Date of Patent: Apr. 3, 2012

(54) CORRECTING BRIGHTNESS VARIATIONS IN ORGANIC ELECTROLUMINESCENT PANEL

(75) Inventors: Seiichi Mizukoshi, Kanagawa (JP); Makoto Kohno, Kanagawa (JP); Kouichi Onomura, Yokohama (JP)

(73) Assignees: Semiconductor Manufacturing International (Shanghai) Corporation, Shanghai (CN); Global OLED Technology, LLC., Wilmington, DE (US)

( * ) Notice: Subject to any disclaimer, the term of this patent is extended or adjusted under 35 U.S.C. 154(b) by 557 days.

(21) Appl. No.: 12/401,126

(22) Filed: Mar. 10, 2009

(65) Prior Publication Data

US 2009/0237334 A1 Sep. 24, 2009

(30) Foreign Application Priority Data

Mar. 18, 2008 (JP) ..... 2008-068632

(51) Int. Cl.
*G09G 3/30* (2006.01)

(52) U.S. Cl. ..... 345/77; 345/76; 345/690

(58) Field of Classification Search ..... 345/77
See application file for complete search history.

(56) References Cited

U.S. PATENT DOCUMENTS

| | | | | |
|---|---|---|---|---|
| 3,828,320 | A * | 8/1974 | Dinerman et al. | 711/147 |
| 7,345,660 | B2 | 3/2008 | Mizukoshi et al. | |
| 2006/0098003 | A1 * | 5/2006 | Koyama et al. | 345/204 |
| 2007/0273701 | A1 * | 11/2007 | Mizukoshi et al. | 345/531 |

FOREIGN PATENT DOCUMENTS

| | | |
|---|---|---|
| JP | 11-282420 | 10/1999 |
| WO | 2005-101360 | 10/2005 |

* cited by examiner

*Primary Examiner* — Quan-Zhen Wang
*Assistant Examiner* — Nelson D Runkle, III
(74) *Attorney, Agent, or Firm* — McKenna Long & Aldridge, LLP.

(57) ABSTRACT

An OLED display having a correction circuit for producing corrected image data in response to the first image data and in response to correction data to correct for brightness unevenness due to TFT variations; a memory for storing first image data or correction data; a switch effective in first and second states in response to a function switching signal having first and second conditions, respectively; and circuitry for causing the switch to be in the first state to connect the memory to the image input signal interface and to provide the stored first image data to the panel as the second image data; and for causing the switch to be in the second state to connect the memory to the correction circuit, provide the stored correction data to the correction circuit, and provide the corrected image data to the panel as the second image data.

7 Claims, 9 Drawing Sheets

CORRECTING BRIGHTNESS VARIATIONS IN ORGANIC ELECTROLUMINESCENT PANEL

CROSS-REFERENCE TO RELATED APPLICATION

This application claims priority of Japanese Patent Application No. 2008-068632 filed Mar. 18, 2008 which is incorporated herein by reference in its entirety.

FIELD OF THE INVENTION

The present invention relates to a driver IC for a display, and an organic electroluminescence ("EL") panel which uses the driver IC.

BACKGROUND OF THE INVENTION

Conventionally, an organic EL display is known. The organic EL display includes a driving thin film transistor ("TFT") for driving the organic EL element with a current, and in the organic EL display, an amount of current of the driving TFT is controlled according to image data.

Due to reasons such as a problem in manufacturing or degradation with elapse of time, the Vth of the driving TFT or a slope (μ) of the V-I characteristic can vary, resulting in brightness unevenness. In order to correct the unevenness, there are cases in which a predetermined value is added to the image data for driving the pixels to correct Vth (offset correction) and in which the image data is multiplied by a predetermined value to correct μ (gain correction).

FIG. 3 shows a method of calculating correction data and FIG. 4 is a block diagram of a correction circuit. First, voltage-current characteristics of a number of pixels are measured in order to determine a curve of the V-I characteristic of standard pixels in the panel. A function f(x) is determined assuming that this curve is a curve represented by an equation of $I=f(a(V-b))$. Assuming that a total of pixels of the panel is represented by f(x) and the variation in the characteristics is due to differences in the coefficients a and b, it is possible to determine the coefficients a and b of the pixels by, for example, measuring pixel currents corresponding to two or more input voltage levels.

When the V-I characteristic of a pixel p is represented by $I=f(a'(V-b'))$, it is possible to determine, based on the coefficients a and b for an average pixel which are already determined, $offset=k(b'-ab/a')$ and $gain=a/a'$ with the coefficient k being a coefficient of the D/A conversion, and correction can be executed by multiplying the image data by the determined gain and adding the determined offset.

More specifically, as shown in FIG. 4, for each of an R signal, a G signal, and a B signal which are image data, γ-corrected image data is obtained in a γ lookup table (γLUT) 10 for obtaining a linear relationship between input pixel data and pixel current. The γ-corrected image data is multiplied by the correction gain, gain, in a multiplier 12 and a correction offset, offset, is added in an adder 14.

An image signal (R, G, B) for which unevenness is corrected is supplied to a display panel 18 through a data driver 16 having a data latch and a D/A converter, and is displayed in the display panel 18. A gate driver 20 is connected to the display panel 18, and the gate driver 20 controls to which line of the display panel 18 the image data is supplied.

A timing signal generating unit 22 generates various timing signals based on a pixel clock, a horizontal synchronization signal, and a vertical synchronization signal, and also generates an address of a memory 24. The memory 24 includes a RAM which can be read and written quickly, and, when the power supply is started up, correction data (gain, offset) are sent from an external nonvolatile memory or the like through a correction data transferring circuit 26, and is stored in the memory 24. The timing signal generating unit 22 generates, in correspondence with the image data of each pixel, an address at which the correction data for that pixel is stored, the correction data for each pixel is read from the memory 24, and the correction data are supplied to the multiplier 12 and the adder 14 through a correction gain generating circuit 28 and a correction offset generating circuit 30. The correction gain generating circuit 28, the correction offset generating circuit 30, the multiplier 12, and the adder 14 form a correction calculating unit 29.

In this manner, the unevenness can be significantly improved by calculating the γ-corrected signal data. Such an unevenness correction is described in, for example, JP 11-282420; U.S. Pat. No. 7,345,660, U.S. Patent Application Publication No. 2007/273701 and WO 2005/101360.

Some driver ICs for mobile devices have a built-in display RAM (display memory) which is called a graphic RAM, and do not require, once a static image is written to the display memory, transfer of the image signal from the outside unless the display image is to be changed. In FIG. 5, an image input signal interface 32 has functions to temporarily store an input image signal having 8 bits for each color in a display memory 34 and to send the stored image to the γLUT 10. In addition, for a signal which is continuously input in synchronization to the pixel clock, the signal can be sent to the γLUT 10 without any processing. The switching between these operations is achieved by a switching signal from a CPU or the like on the side of the system. In addition, in general, graphic functions are provided in which a line or a drawing is written on an image on the display memory 34, an image is scrolled, or an image is enlarged or reduced.

In a driver IC having such a display memory 34, although there are advantages that the unnecessary radiation from the data bus between the system-side circuit and the driver IC can be reduced, the power consumption by the data transfer can be reduced, and the load of the system-side circuit can be reduced, there also is a disadvantage in that the chip size is increased because of the large-capacity memory, and consequently the cost is increased. Currently, in general, a display memory is equipped in many cases in a panel for a portable phone having more frequent occurrences of occasions to display a still image, and the display memory is not equipped in a built-in panel for a monitor of a digital camera and a video camera which frequently displays an animated image also. Therefore, the determination of whether or not the display RAM is to be equipped cannot be generally made, and is currently comprehensively made according to the application.

When all pixels are to be corrected using the unevenness correction circuit, the correction data is required for each pixel, and consequently a memory for storing the data for the number of pixels of the panel is required. Currently, as shown in FIGS. 6 and 7, correction is executed by writing data of the unevenness in an external nonvolatile memory 36 at the time of shipping of the panel, reading all correction data to the memory (RAM) 24 in the driver IC when the power supply of the panel module is started up, and correcting with the use of the data in the memory 24. In this example configuration, the nonvolatile memory 36 is mounted on a flexible cable 38.

In the case of a display panel 18 with a large number of pixels, a large-capacity RAM would be required as the memory 24, which affects the chip size of the driver IC and also increases the cost. As described, the occupied percentage of the correction memory 24 in the size of the driver IC is significant, and for a panel having a smaller number of occurrences of the unevenness because of optimization of the TFT manufacturing process or devising of the pixel circuit, it is advantageous, in view of the cost, to not equip the circuit for unevenness correction using an external circuit in the panel.

On the other hand, some driver ICs for mobile devices are equipped with a display memory 34 which is a display RAM, and in this case also, the memory for the number of pixels of the panel is used. However, as described above, there are some applications that do not require the display memory.

In other words, in an ideal structure, for a panel having the same number of pixels and the same driving method, four types of driver ICs are provided including a driver IC having neither the unevenness correction function nor the display memory function, a driver IC having only the unevenness correction function, a driver IC having only the display memory function, and a driver IC having both the unevenness correction function and the display memory function, and the driver ICs are used differently according to the usage. However, in reality, it is difficult to develop four types of driver ICs in view of the development cost and the number of steps for development, and furthermore, because of the variation of the types of the components, cost reduction by mass production cannot be expected.

SUMMARY OF THE INVENTION

According to one aspect of the present invention, there is provided a driver IC for a display comprising an unevenness correcting unit which executes a calculation based on image data which is input and correction data for correcting variation in brightness among pixels and corrects the brightness unevenness, a display memory unit which outputs stored image data when a same image is displayed, and a memory which can selectively store correction data which is used in the unevenness correcting unit or image data which is used in the display memory unit, wherein it is possible to select which of the unevenness correcting unit and the display memory unit uses the memory.

According to another aspect of the present invention, it is preferable that the driver IC is applied to an organic electroluminescence panel.

According to various aspects of the present invention, it is possible to select whether the memory is used for unevenness correction or as a display memory. Because of this, a driver IC can be provided in which the chip size is not significantly affected and the unevenness correction function and the display memory function can be selectively used according to the usage.

BRIEF DESCRIPTION OF THE DRAWINGS

Preferred embodiments of the present invention will be described in detail with reference to the drawings, wherein.

DETAILED DESCRIPTION OF THE INVENTION

A preferred embodiment of the present invention will now be described with reference to the drawings.

Figure 1:
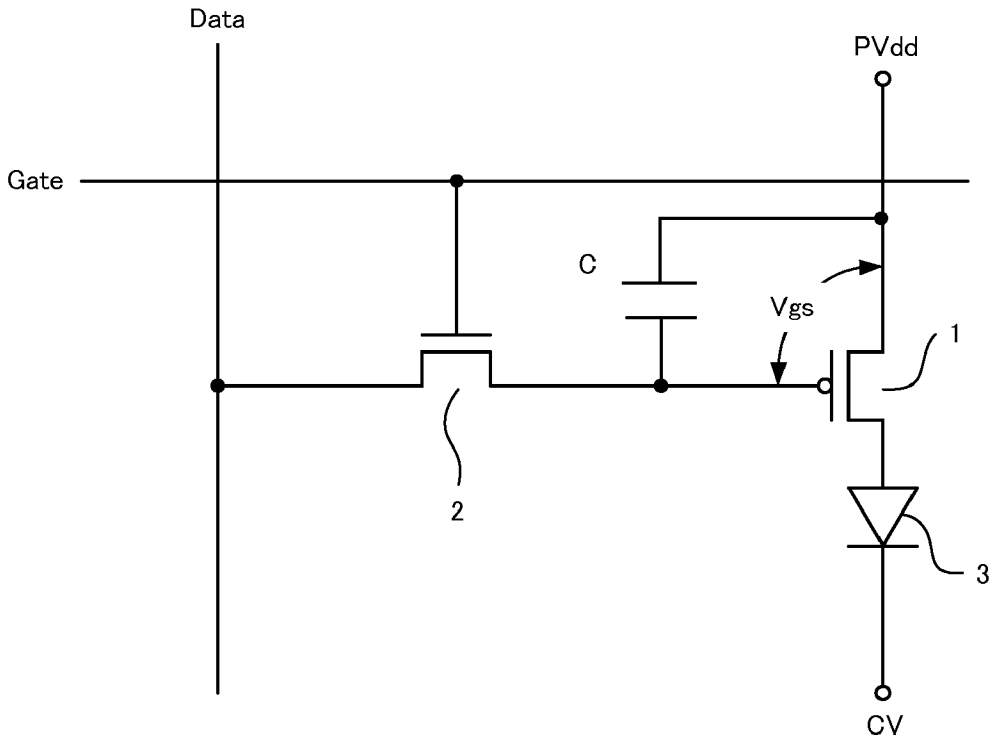
FIG. 1 Prior Art
FIG. 1 is a diagram showing a structure of a pixel circuit.
Figure 2:
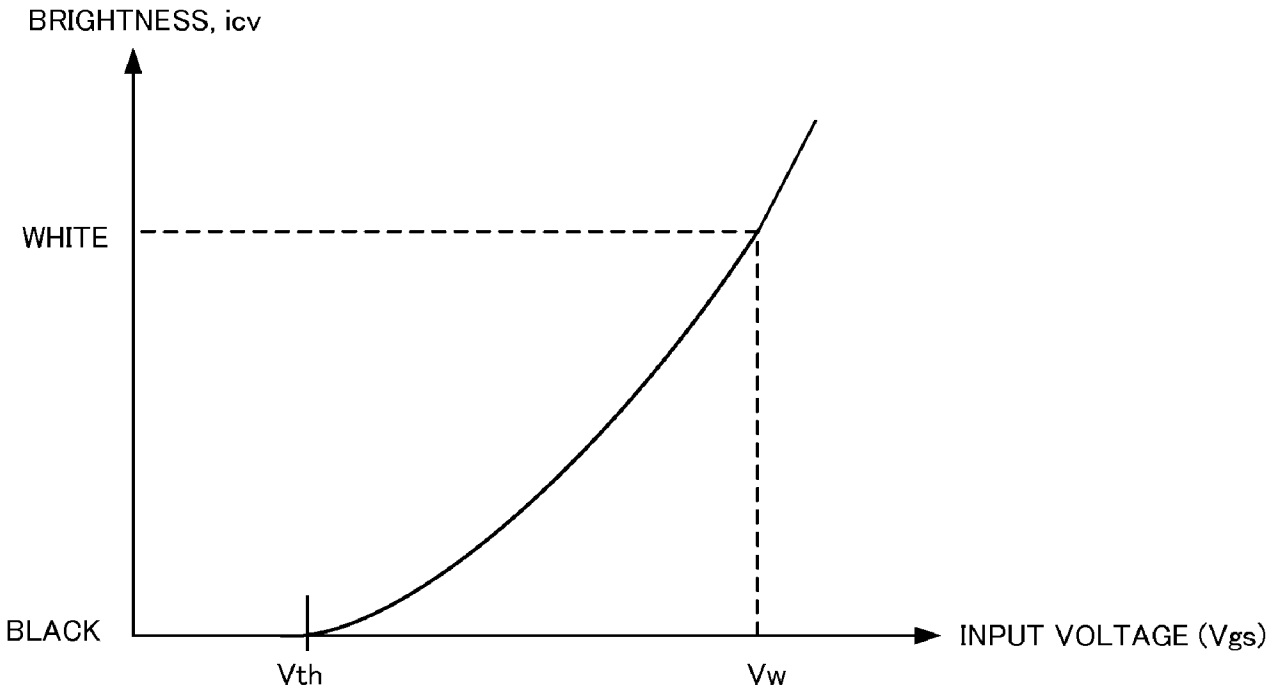
FIG. 2 Prior Art
FIG. 2 is a diagram showing a relationship between an input voltage and a current.
Figure 3:
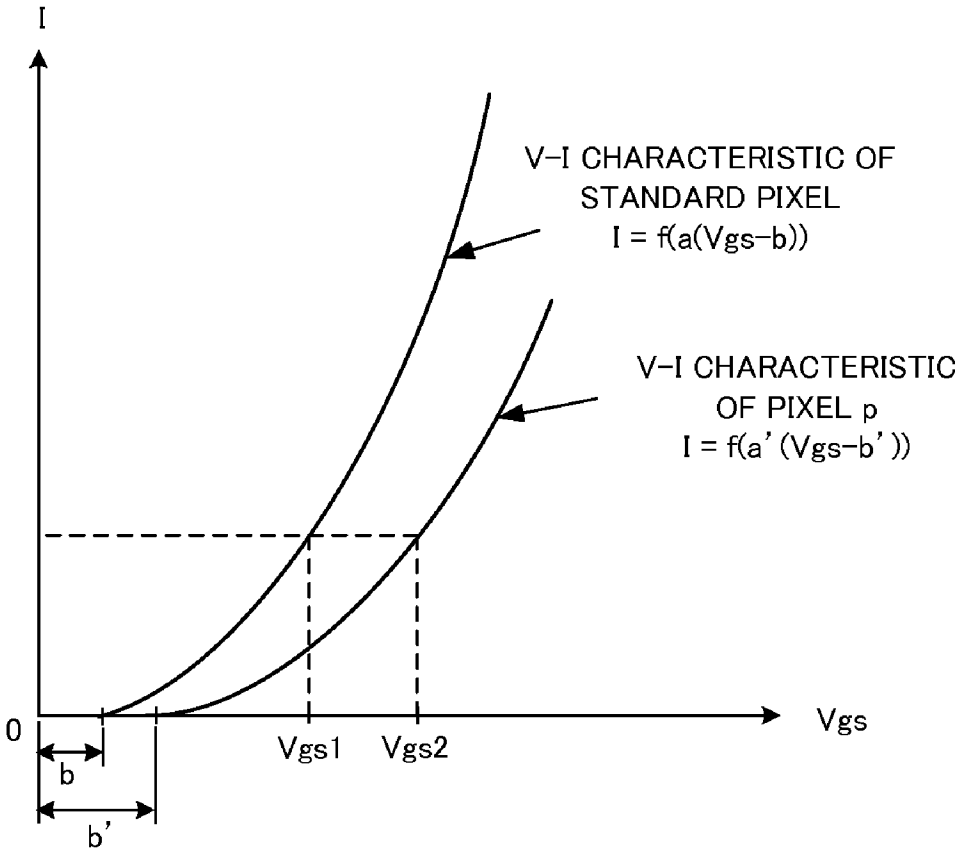
FIG. 3 Prior Art
FIG. 3 is a diagram showing a difference in characteristics among pixels.
Figure 4:
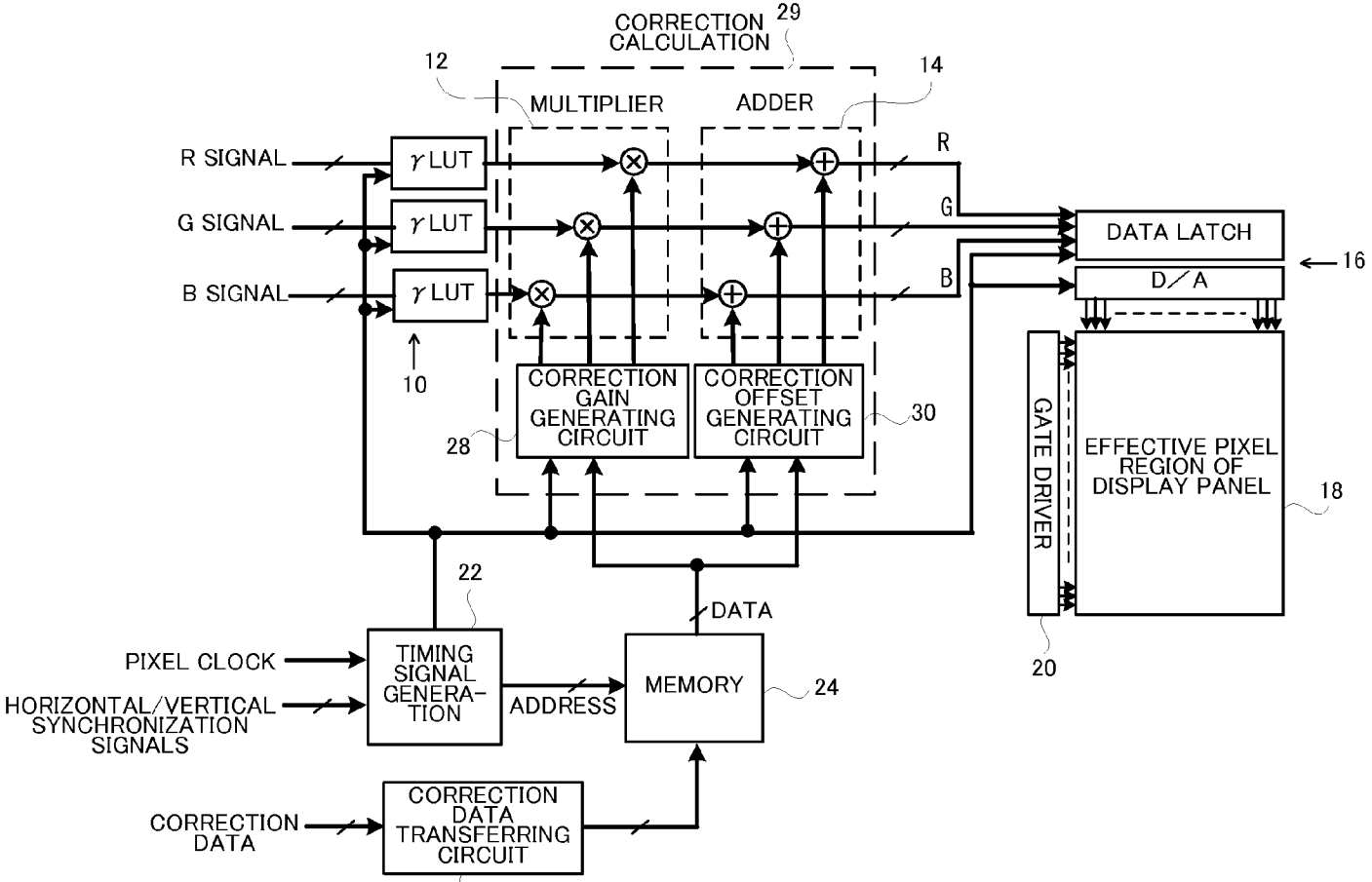
FIG. 4 Prior Art
FIG. 4 is a diagram showing a structure for unevenness correction.
Figure 5:
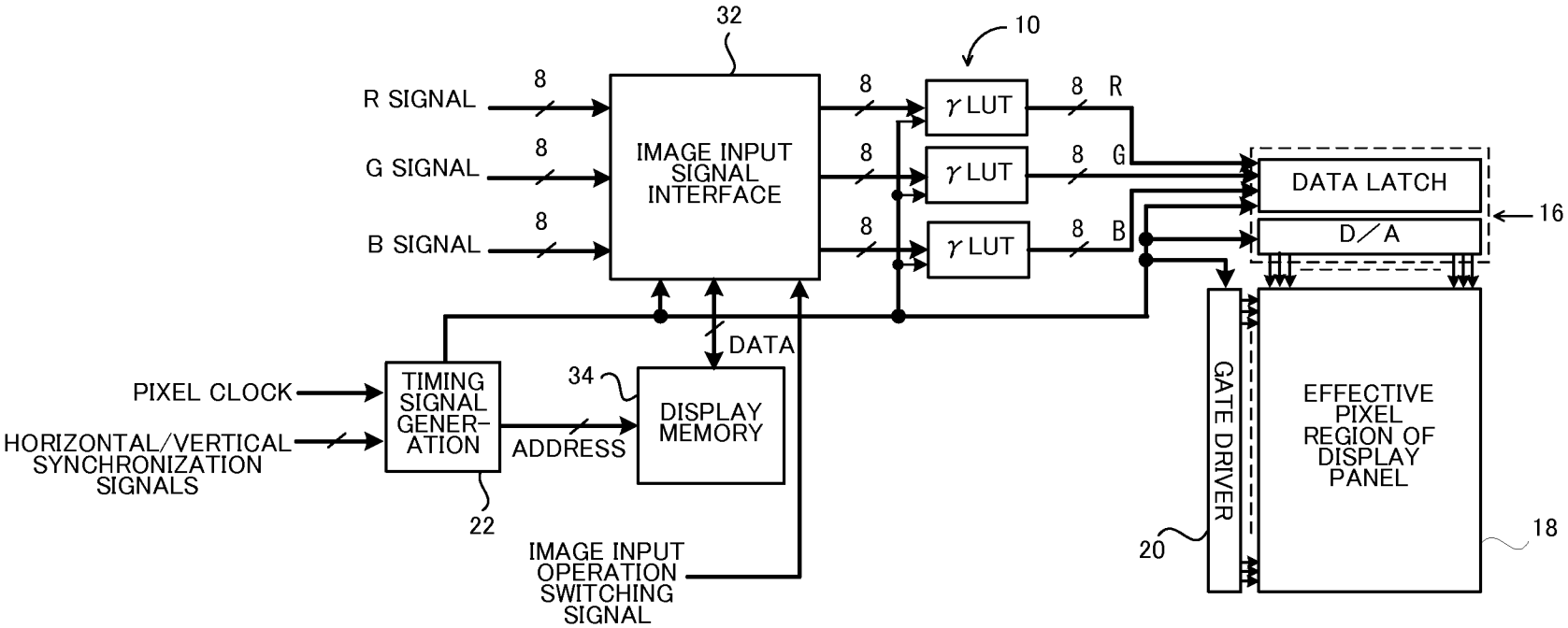
FIG. 5 Prior Art
FIG. 5 is a diagram showing a structure when a display memory is used.
Figure 6:
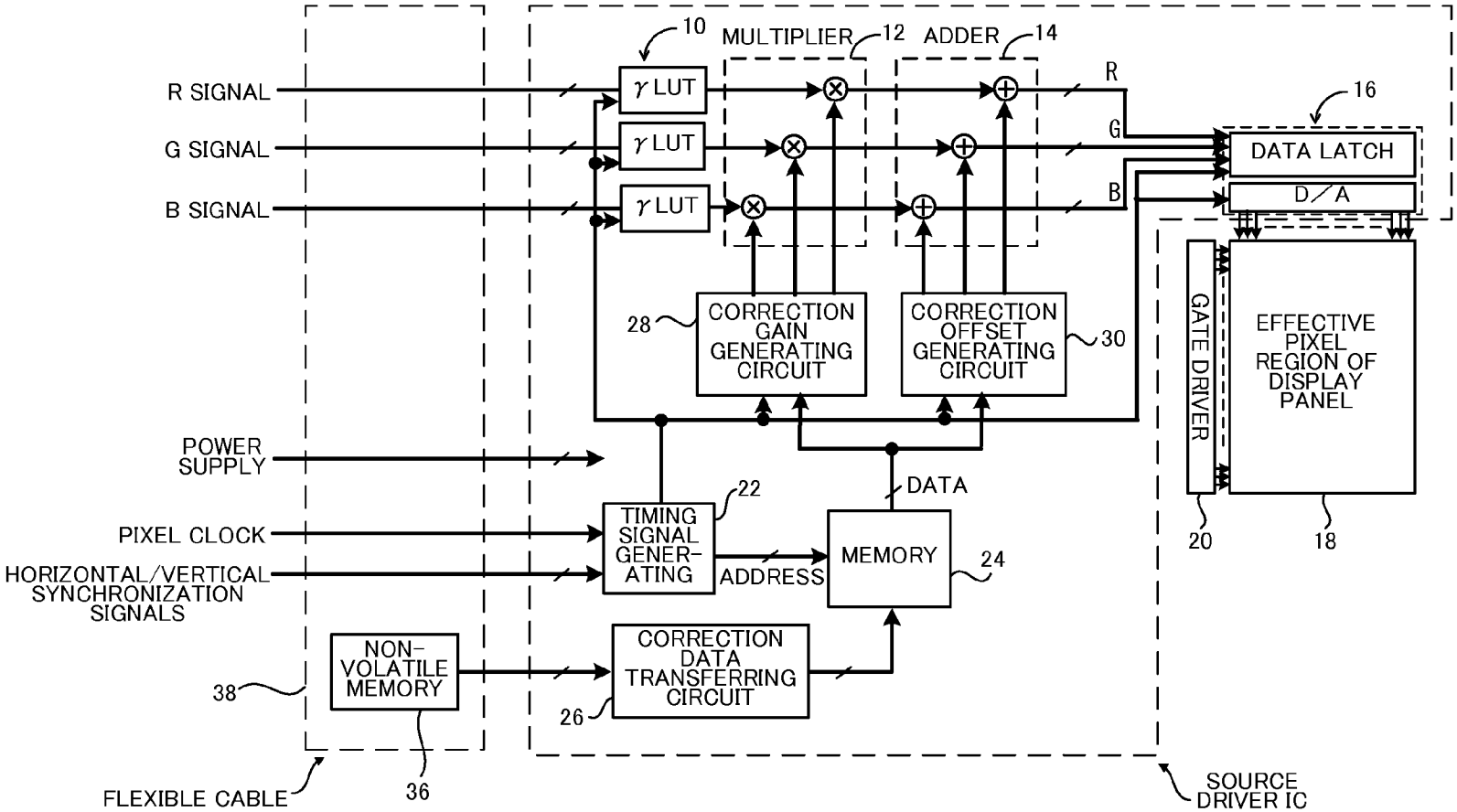
FIG. 6 Prior Art
FIG. 6 is a diagram showing a structure in which a nonvolatile memory for storing correction data is provided.
Figure 7:
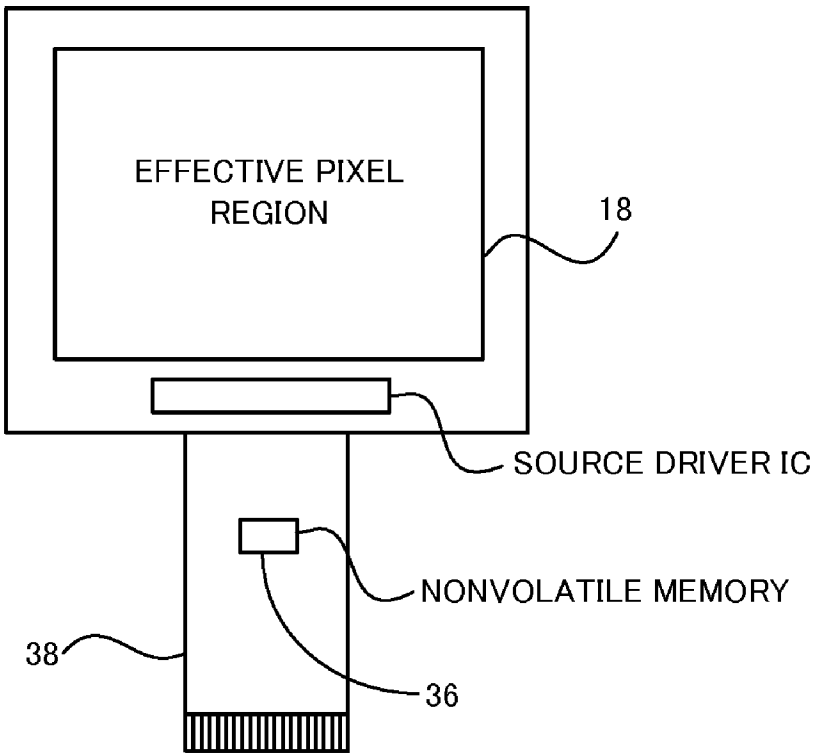
FIG. 7 Prior Art
FIG. 7 is a diagram showing a structure in which a nonvolatile memory for storing correction data is provided on a flexible cable.
Figure 8:
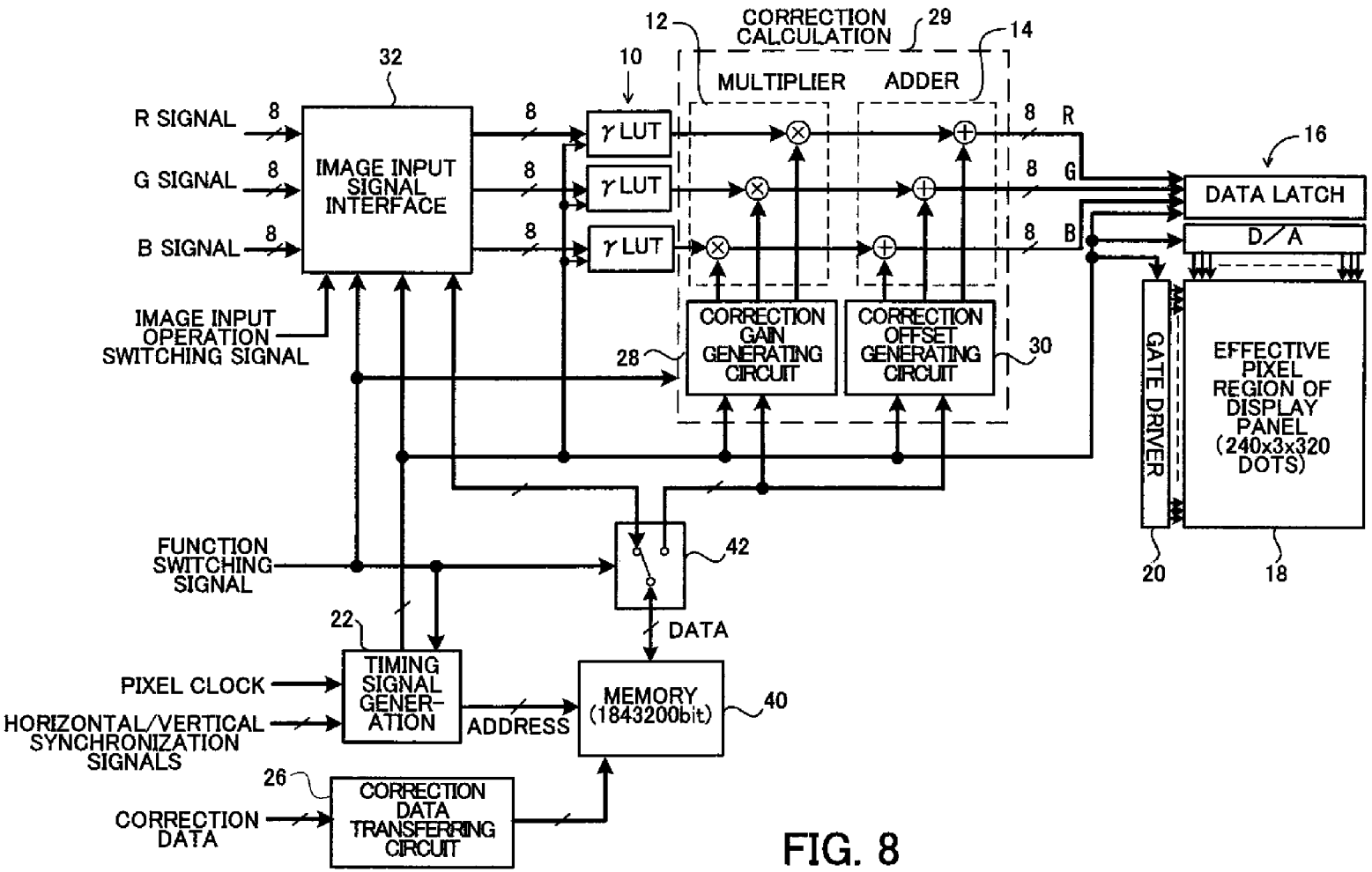
FIG. 8 is a diagram showing a structure of a preferred embodiment of the present invention.

FIG. 8 is a block diagram of a preferred embodiment of the present invention. As shown, a driver IC includes a memory 40 which is selectively connected by a switch 42 to an image input signal interface 32 or a correction calculating unit 29.

In addition, all timing signals in the driver IC including the address of the memory 40 generated by the timing signal generating unit 22 are also switched according to the function. From the viewpoint of reduction of the power consumption, it is desirable that the clock and the timing pulse which are input to a circuit which is only used for one of the functions are stopped when the function is not being selected.

The switching of the functions is executed by, for example, connecting a function switching signal pin to a power supply or to a ground on a flexible cable during a production process. In addition, similar to settings such as the brightness and hue of the display, the setting can be realized by an output signal of a microcomputer or by storing a setting in the above-described external flash memory and reading the setting at the startup of the power supply.

When a function switching single is set, the switch 42 connects the memory 40 to one of the image input signal interface 32 and the correction calculating unit 29.

When the memory 40 is used as the display memory, the image input signal interface 32 is connected to the memory 40. When the same image is to be displayed, a CPU at the outside supplies, according to the status of the display, an instruction that the same image is to be displayed to the image input signal interface 32 with an image input operation switching signal. In this case, the image input signal interface 32 temporarily stores an input image signal in the display memory 34 and then sends the stored image to the γLUT 10. With this process, the image signal in the memory 40 is repeatedly displayed on the display panel 18. In addition, it is also possible to realize graphic functions, with an instruction from the CPU, to write a line or a drawing on an image on the display memory 34, to scroll the image, and to enlarge or reduce the image.

In the case of display of an animated image, on the other hand, signals which are continuously input in synchronization to the pixel clock are sent to the γLUT 10 without any processing. In this manner, a display similar to the normal display is realized on the display panel 18.

When the memory 40 is used as the display memory for correction data, the correction calculating unit 29 is connected to the memory 40. During startup of the power supply or the like, correction data stored in the external nonvolatile memory is written by the correction data transferring circuit 26 to the memory 40, and the correction data is supplied to the correction calculating unit 29.

A size of the memory 40 when the memory 40 is used as a display memory is, for example, for a panel of QVGA size (240 RGB×320) with a sub-pixel of 8 bits, 240×3×320×8=1843200 bits.

On the other hand, when the memory 40 is used as the memory for unevenness correction, 8 bits can be assigned for 1 dot. In this case, when only the threshold voltage Vth of the driving TFT is to be corrected, that is, only the offset is to be corrected, 8 bits can be assigned for the offset correction. When, on the other hand, μ, that is, gain, is also corrected, 4 bits can be assigned to each of the offset and gain corrections.

Figure 9:
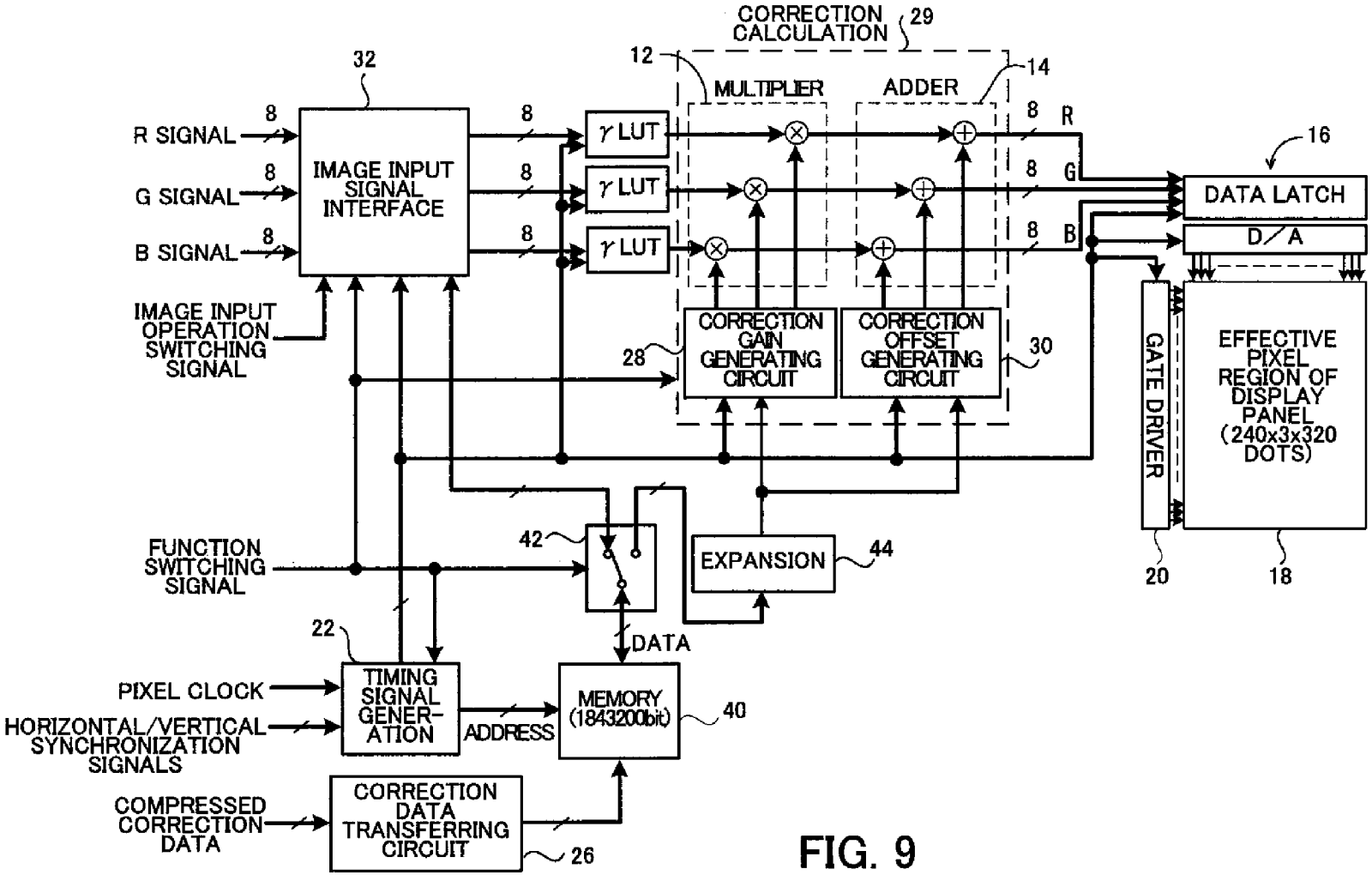
FIG. 9 is a diagram showing another structure of a preferred embodiment of the present invention.

With 4 bits, however, there can be cases where a dense unevenness cannot be sufficiently corrected, and it is thus desirable to compress data as described in U.S. Patent Application Publication No. 2007/273701. When the data compression of U.S. Patent Application Publication No. 2007/273701 is used, the density of the unevenness which can be corrected is not limited by the size of the memory 40, and a total amount of unevenness over the whole panel which can be corrected is limited by the size of the memory 40. Normally, even when both the offset and the gain are corrected, the above-described memory size is sufficient unless there is a dense unevenness over the entire display. FIG. 9 is a block diagram of an example structure in this case.

The compressed correction data is written to the memory 40 through the correction data transferring circuit 26. An expansion circuit 44 is provided between the switch 42 and the correction gain generating circuit 28 and the correction offset generating circuit 30. Therefore, when the memory 40 is used for unevenness correction, the compressed correction data is stored in the memory 40 and is expanded by the expansion circuit 44, and is used for correction.

In the present embodiment, the storage unit to be used for unevenness correction and the storage unit to be used for display memory function are combined into the memory 40, and the unevenness correction function and the display memory function are set to be selectable with one driver IC. With this structure, it is possible to realize a driver IC having only the unevenness correction function or only the display memory function with one type of driver IC. In this case, when the unevenness correction function is selected, the logic unit which is used for the display memory function is not used and is redundant, and when the display memory function is selected, on the other hand, the logic unit which is used for the unevenness correction function is not used and is redundant. However, the occupied ratio of these logic units within the chip size is very small compared to that of the RAM and the D/A converter, and the provision of these units does not significantly affect the chip size of the IC. In general, with the sharing of the driver IC, the advantages of the reduction of the cost by the reduction in the development cost and advantages of scales is greater than the above-described disadvantage.

The invention has been described in detail with particular reference to certain preferred embodiments thereof, but it will be understood that variations and modifications can be effected within the spirit and scope of the invention.

PARTS LIST

10 γLUT
12 multiplier
14 adder
18 display panel
20 gate driver
22 generating unit
22 timing signal generating unit
24 memory
24 correction memory
26 data transferring circuit
28 gain generating circuit
29 correction calculating unit
30 offset generating circuit
32 signal interface
34 display memory
36 nonvolatile memory
38 flexible cable
40 memory
42 switch
44 expansion circuit

The invention claimed is:

1. An electroluminescence display, comprising:

(a) an image input signal interface for receiving first image data;

(b) a correction circuit for producing corrected image data in response to the first image data and in response to correction data to correct for brightness unevenness due to TFT variations;

(c) a memory for storing first image data or correction data;

(d) a switch effective in first and second states in response to a function switching signal having first and second conditions, respectively;

(e) a panel for emitting light in response to second image data; and (f) a timing signal generation circuit that receives a pixel clock and horizontal/vertical synchronization signals and provides a plurality of timing signals to the image input signal interface, wherein the switch in response to the function switching signal in its first condition connects the memory to the image input signal interface and to provide the stored first image data to the panel as the second image data; and wherein the switch in response to the function switching signal in its second condition connects the memory to the correction circuit to provide the stored correction data to the correction circuit and to provide the corrected image data to the panel as the second image data.

2. The electroluminescence display of claim 1, wherein the panel is an organic electroluminescence display panel.

3. The electroluminescence display of claim 1, wherein the stored correction data are compressed correction data, and further including an expansion circuit for receiving the compressed correction data and providing expanded correction data to the correction circuit.

4. The electroluminescence display of claim 1, wherein the correction circuit includes a correction gain generating circuit and a correction offset generating circuit.

5. The electroluminescence display of claim 4, further comprising a gamma look-up table between the image input signal interface and the correction circuit.

6. The electroluminescence display of claim 1, wherein the function switching signal is provided to the image input signal interface.

7. The electroluminescence display of claim 1, wherein the timing signal generation circuit generates an address signal for the memory.

* * * * *